United States Patent [19]

Bosnjak

[11] 4,135,309

[45] Jan. 23, 1979

[54] PROCESS FOR DRYING BEET PULP

[75] Inventor: Milovan Bosnjak, Denver, Colo.

[73] Assignee: Buttes Gas & Oil Co., Oakland, Calif.

[21] Appl. No.: 814,497

[22] Filed: Jul. 11, 1977

[51] Int. Cl.[2] ..... F26B 5/14; F26B 7/00

[52] U.S. Cl. ..... 34/14; 34/17; 34/19; 34/35; 426/456; 426/465

[58] Field of Search ..... 34/17, 19, 35, 14; 426/456, 465

[56] References Cited

U.S. PATENT DOCUMENTS

| | | | |
|---|---|---|---|
| 2,718,710 | 9/1955 | Spooner | 34/35 |
| 3,328,172 | 6/1967 | Smith, Jr. | 34/35 X |
| 3,795,987 | 3/1974 | Kemmetmueller | 34/35 X |
| 4,058,634 | 11/1977 | Kunz | 34/17 X |

*Primary Examiner*—Leland A. Sebastian

*Attorney, Agent, or Firm*—Edwin L. Spangler, Jr.

[57] ABSTRACT

This invention relates to an improved pulp drying process for indirectly drying beet pulp which is characterized by the inclusion of a steam heated dryer of the type wherein the process steam used in the drying operation remains isolated from the vapors driven off the pulp so that the latter remain clean, uncontaminated and ideally suited for use in process heating. The invention also contemplates the removal of entrained solids from the evolved vapor prior to stripping the heat therefrom. A further refinement contemplates the inclusion of a preheating step wherein the pressed pulp is preheated preparatory to being dried.

7 Claims, 1 Drawing Figure

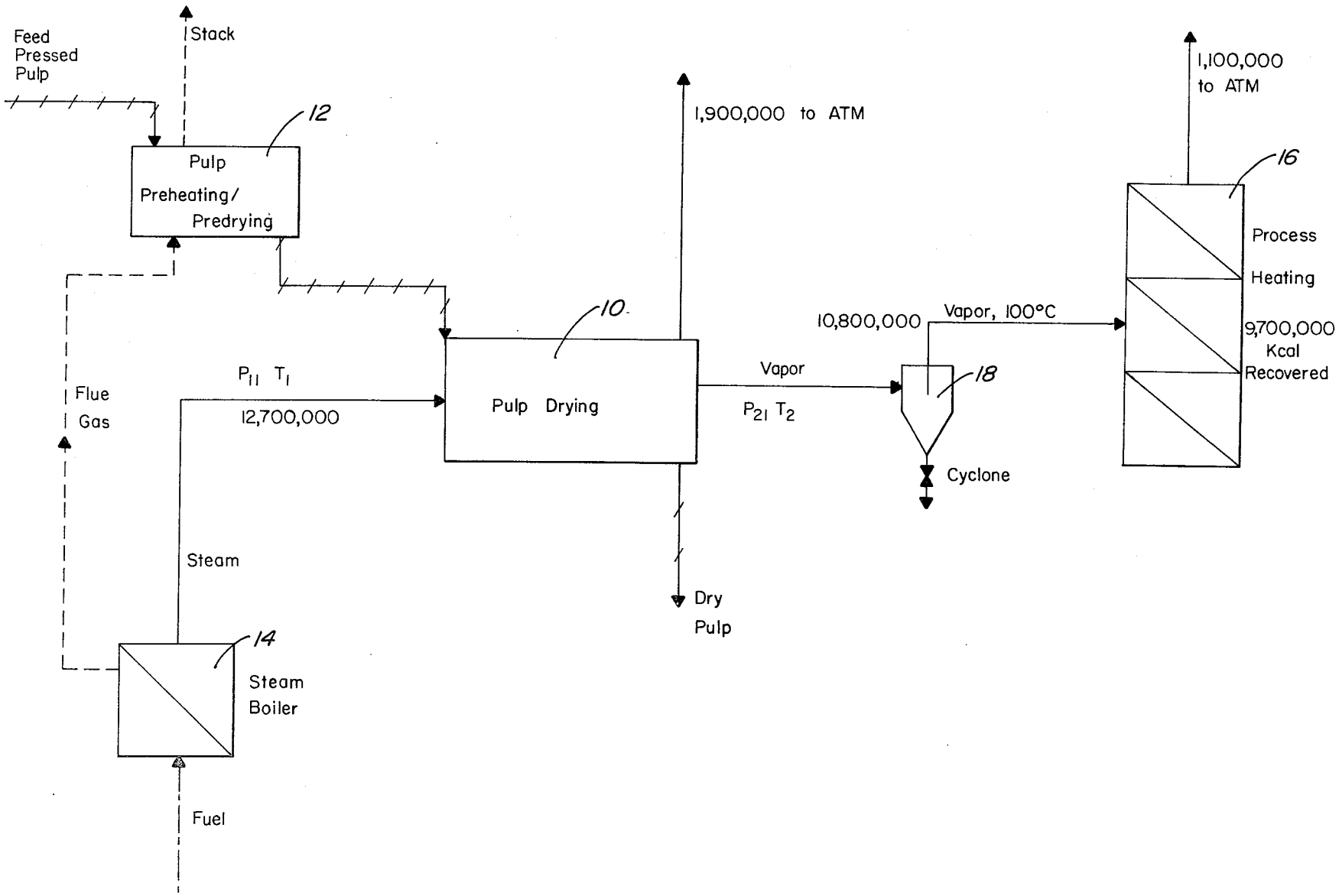
1,100,000 to ATM
16
Process Heating
9,700,000 Kcal Recovered
Vapor, 100°C
18
Cyclone
10,800,000
1,900,000 to ATM
Vapor
$P_2$, $T_2$
Dry Pulp
10
Pulp Drying
12
Pulp Preheating/ Predrying
Stack
Feed Pressed Pulp
$P_1$, $T_1$
12,700,000
Steam
14
Steam Boiler
Fuel
Flue Gas

PROCESS FOR DRYING BEET PULP

In a conventional beet sugar refinery, some 16,000,000 kcal of heat is required per 100 tons of beets to dry the beet pulp to a point where it is suitable for further processing. This, moreover, is in addition to the energy used to press the pulp to a point where it consists of 20% or more dry solids before it is even dried.

Since only some 32,000,000 kcal per 100 tons of beets are required to process the beets into sugar, it is easy to see that about half as much energy is consumed in the drying operation as is used in the entire sugar processing operation that proceeds it. Engineers skilled in beet sugar technology generally allocate no less than 30% of the entire energy requirements to the drying operation.

Notwithstanding the fact that a disproportionate share of the total energy requirements are consumed in the drying stage of the process, there remain other considerations which are equally serious, if not more so. To begin with, the vapors generated during the drying operation are discarded and the considerable heat contained therein is wasted. The reasons for this are severalfold, the main one being that these vapors are so dirty and contaminated with dust from the beets, ashes from the fuel used to fire the dryer, and products of combustion, that it quickly plugs up any conventional heat exchanger employed as a means for stripping the heat therefrom.

Ancillary to this contamination problem and one of the main causes thereof is the necessity for having air at relatively high velocities moving through the pulp dryer at all times the drying operation is being carried out therein. This moving airstream serves to stir up the dust and other contaminants which would, otherwise, tend to remain more or less quiescent inside the dryer. Be that as it may such a moving airstream is necessary for efficient drying even though it is directly responsible for suspending many of the contaminants in the evolved vapors.

Another serious, though less significant, problem is that of scorching the pulp by having to fire the dryer at temperatures of around 2000° F. The resulting dried pulp ends up charred, discolored and of generally inferior quality.

From a cost standpoint, gas or coal fired driers of the type currently in use for pulp drying require extensive fuel storage and fuel handling facilities which must be considered in the overall processing costs. Moreover, as clean air standards get progressively stricter, the need for expensive antipollution equipment becomes nearer and nearer a reality.

It has now been found in accordance with the teaching of the instant invention that these and other shortcomings of the prior art processes for the drying of beet pulp can, in large measure at least, be overcome by the simple, yet unobvious, expedient of indirectly drying the pulp in a steam heated dryer while gently tumbling it so as to not unnecessarily contaminate the vapors evolved with stirred up dust. The high velocity airstream of the prior art drying method is eliminated altogether as is the mixing of the products of combustion with the vapors, such products constituting between 40% and 50% of the latter in accordance with present practices. Scorching of the pulp is also completely eliminated due to careful temperature control, the virtual elimination of "hot spots" in the dryer and, most important, the opportunity to use lower drying temperatures.

The most significant advantage of the instant pulp drying process is, of course, the capability of producing relatively clean saturated vapors, a good deal of the heat in which can be reclaimed for process heating. In fact, as will be shown presently, the approximately 20% heat recoverable from the vapors evolved during the pulp drying operation is just slightly in excess of that which is required to satisfy all the process heating requirements in a sugar refinery. The excess amounting to around 2% is adequate to cover all losses and insure the reliability of the system by being able to meet unexpected demands and other process variables.

As matters now stand, those beet sugar refineries which even bother to dry their pulp do so in an entirely separate operation. Since they already use steam boilers as a source of both energy and heat, they could, in accordance with the teaching of the instant invention, merely include a pulp drying step consuming some 3,000,000 kcal or so per hundred tons of beets and eliminate the usual pulp drying operation altogether. Since some 16,000,000 kcal/100 tons of beets are ordinarily consumed in pulp drying, this is a net saving of 13,000,000 kcal or thereabouts.

Accordingly, it is the principal object of the present invention to provide a novel and improved process for the drying of beet pulp.

A second objective is the provision of a process of the type aforementioned wherein the evolved products consist of relatively clean saturated vapors containing little dust or other particulate matter and no products of combustion.

Another objective is to provide a pulp drying process wherein the reclaimable heat is quite sufficient to satisfy the process heating requirements of the ordinary beet sugar factory while leaving just enough left over to cover the losses and meet unforeseen contingencies.

Still another objective is the provision of a process for drying beet pulp which is acceptable from an environmental standpoint in that it virtually eliminates atmospheric contamination with heat, particulate matter and noxious gases while, at the same time, making more efficient use of scarce natural resources.

An additional object is the provision of a process of the type disclosed and claimed herein which, at least with respect to new sugar beet factories, requires little, if any, increase in capital investment due to the elimination of just the fuel storage and handling facilities without regard to the extremely expensive antipollution equipment likely to be required in the very near future.

Further objects are to provide a beet pulp drying process which is clean; efficient; versatile; easy to control; simple to operate, service and maintain; and one that produces a vastly superior product at less cost.

Other objects will be in part apparent and in part pointed out specifically hereinafter in connection with the description of the single FIGURE of drawings that shows the pulp drying process of the present invention in terms of a schematic flow diagram.

Before proceeding with a detailed description of the invention in terms of the aforesaid schematic representation thereof, it would be wise to first consider how the beet pulp drying operation is currently being carried out with particular emphasis upon its energy requirements.

As previously noted, conventional beet pulp drying requires about 16,000,000 kcal per 100 tons of beets which is right at half the energy requirements for processing the beets into sugar. In a conventional plant, the beets can be pressed to squeeze the excess water therefrom preparatory to drying until the pulp contains about 22% dry solids; however, for purposes of the present calculations, it will be assumed that the resultant pulp contains only 20% dry solids.

Pulp containing the above percentage of solids must be dried to a point where it contains approximately 10% moisture. It is worthy of note that the average yield of dried pulp is only around 5% based upon the total tonnage of beets processed. It follows, therefore, that some 20 tons of water must be evaporated for each 100 metric tons of beets processed per hour. Based upon a heat of evaporation of 540 kcal/kg., some 10,800,000 kcal/hr.(Q) are theoretically required to produce the 20 tons of vapor per hour from the pulp; however, the actual energy requirements vary greatly depending upon the type of dryer used, working conditions, etc. As an example, it can be shown that for direct fired rotary drum dryers of the type currently in use in the beet sugar industry, some 16,000,000 kcal/hr. is required to handle evaporation of the 20 tons of water per hour. The actual work of evaporation (W) is only some 5,400,000 kcal/hr. calculated in accordance with the following formula:

$$W = Q\left(\frac{To}{T_2} - \frac{To}{T_2 + dT}\right) \quad (1)$$

where Q = 10,800,000 kcal/hr. due to the high operating temperatures and resulting high dT. The difference between the 5,400,000 kcal/hr. theoretical energy requirement and the actual 16,000,000 kcal/hr. used for evaporating the 20 tons of water are attributable to furnace efficiency, excess air and heat losses, radiation and exhaust. While it is theoretically possible to recover a substantial proportion of this heat, it is impractical to do so because it is contained in a very large volume of gases having a relative humidity of 70% or less and which is virtually "loaded" with fine sticky dust. Dust removal alone would require special solutions and processing equipment that render the cost of doing so prohibitive from a cost standpoint; yet, stripping of the heat from the vapors is nearly impossible unless this is done.

With this as a background, reference will next be made to the flow diagram when the energy requirements of the instant indirect pulp drying process have been shown. Pressed beet pulp having a solids content of about 20% can either be introduced directly into steam heated dryer 10 or, alternatively and preferably, into preheater 12 where the flue gases from the fuel used to fire steam boiler 14 are used to preheat the pressed pulp preparatory to finally drying the latter. Steam boiler 14 comprises a conventional source of process steam capable of delivering steam at temperature $T_1$ and pressure $P_1$ containing the necessary heat energy required to evaporate 20 tons of water per hour from the pressed pulp. $P_1$ and $T_1$ would vary with local conditions, the pressure ($P_1$) being as low as 50 psig or, alternatively, as high as 150 psig. The selection of the particular quality of steam best able to supply the necessary heat requirements is well within the skill of the art as is the selection of the most economical and efficient source 14 thereof, the latter frequently being a part of an existing installation in which there is little or no capital investment cost to speak of.

As has been noted previously, 10,800,000 kcal of heat is consumed in evaporating the 20 tons of water contained in the 100 tons of beets each hour. Applying formula (1) to a steam heated rotary dryer which, by the way operates at much lower temperatures than a direct fired one, it can be shown that W, instead of being around 0.5 as is the case with a direct fired dryer, drops down to around 0.124. Thus, instead of 5,400,000 kcal/hr. being theoretically required to produce 20 tons of vapor from the pulp, a mere 1,340,000 kcal are theoretically needed per hour. There will, of course, be certain losses between the boiler 14 and dryer 10 as well as within the latter, experience with steam jacketed rotary drum dryers having shown these to be in the neighborhood of only about 7%. Nevertheless, for purposes of calculation, it will be assumed that the boiler delivers an excess of some 40% of the heat theoretically required to the dryer, i.e. 12,700,000 kcal/hr. instead of only about 10,800,000 kcal. This excess is shown in the schematic as a 1,900,000 kcal/hr. loss to the atmosphere.

The practice in the art is to assume that the heat required for the process heating is equivalent to about 24% steam on beets, expressed as "normal" steam. About 25% of this total process heating requirement can be recovered from condensates in the main refining operation leaving only 9,700,000 kcal/hr. to be supplied by the vapors from the pulp drying operation. Since 10,800,000 kcal/hr. are available from the vapors evolved during the drying operation, this leaves an excess of over a million kcal/hr. to cover all losses and insure the reliability of the system, this excess having been shown in the schematic as a 1,100,000 kcal/hr. loss to the atmosphere.

To insure that the vapors generated during the drying operation do not plug up or otherwise contaminate heat exchangers 16, the dust and other particulate matter stirred up as the pulp is tumbled in dryer 10 and is removed prior to stripping the heat therefrom in separator 18. In the particular form shown, separator 18 has been schematically represented as a cyclone type centrifugal separator. It is important to note that the instant process uses no high velocity airstream which carries a large volume of suspended solids and corrosive products of combustion into the evolved vapors; but, instead, the pulp is gently tumbled and agitated in the dryer so that the only contaminates consist of those volatile non-aqueous constituents of the pulp and the dust and other lightweight particulate matter carried thereon.

Thus, it can be seen that the instant process not only more than satisfies the process heating requirements of the refinery simply and economically, it also virtually eliminates most atmospheric pollutants while, at the same time, producing a pulp of greatly increased quality. Moreover, the fire problems and increased maintenance costs ordinarily associated with a fuel fired pulp dryer are considerably reduced. While, admittedly, a higher initial investment cost would be called for to provide a steam jacketed rotary dryer of the size necessary to process the large volume of pulp, it would, in large measure, be offset by the reduced cost due to elimination of the pulp dryer furnace, fuel storage, fuel handling and pollution abatement equipment.

What is claimed is:

1. In a process for the drying of beet pulp following removal of the sugar therefrom wherein the pulp is first pressed to squeeze out a portion of the water and then dried, the improvement which comprises drying the pulp in heat exchange relation with heating medium to vaporize a substantial proportion of the remaining water while keeping the vapors thus produced and said heating medium isolated from one another, separating the vapors from any dust entrained therein and stripping the heat from the dust-free vapor.

2. The improved pulp drying process in which the heating medium is steam.

3. The improved pulp drying process as set forth in claim 1 which includes the step of agitating the pulp while it is being dried.

4. The improved pulp drying process as set forth in claim 1 wherein the drying operation is carried out in an indirectly heated dryer.

5. The improved pulp drying process as set forth in claim 1 wherein the dust is separated from the vapor centrifugally.

6. The improved pulp drying process as set forth in claim 1 wherein the pressed pulp is preheated preparatory to being dried.

7. The improved pulp drying process as set forth in claim 2 wherein the drying operation is carried out in a steam jacketed rotary drum dryer.

* * * * *